US005502905A

United States Patent [19]

Cornelius et al.

[11] Patent Number: 5,502,905

[45] Date of Patent: Apr. 2, 1996

[54] TOOTH HAVING ABRASION RESISTANT MATERIAL APPLIED THERETO

[75] Inventors: Gregory S. Cornelius, Peoria; Dave P. Cressy, Chillicothe; Joseph W. Puckett, Peoria, all of Ill.

[73] Assignee: Caterpillar Inc., Peoria, Ill.

[21] Appl. No.: 233,565

[22] Filed: Apr. 26, 1994

[51] Int. Cl.[6] ..... E02F 3/00

[52] U.S. Cl. ..... 37/460; 37/454

[58] Field of Search ..... 37/450, 451, 452, 37/453, 454, 455, 456, 457, 458, 460, 446, 449, 398

[56] References Cited

U.S. PATENT DOCUMENTS

| | | | |
|---|---|---|---|
| 887,984 | 5/1908 | Thomas | 37/454 |
| 1,395,048 | 10/1921 | McKee | 37/452 |
| 1,778,213 | 10/1930 | Fahrenwald | 37/460 |
| 1,834,391 | 12/1931 | Edmunds | 37/455 |
| 1,835,701 | 12/1931 | Edmunds | 37/460 |
| 2,904,909 | 9/1959 | Ratkowski | 37/458 |
| 3,225,467 | 12/1965 | Troeppl | 37/452 |
| 3,286,379 | 11/1966 | Benetti | 37/142 |
| 3,300,883 | 1/1967 | Troeppl et al. | 37/454 |
| 3,368,293 | 2/1968 | Judkins et al. | 37/458 |
| 3,413,740 | 12/1968 | Petersen | 37/457 |
| 3,751,834 | 8/1973 | Petersen | 37/458 |
| 3,790,353 | 2/1974 | Jackson et al. | 29/182.7 |
| 3,805,423 | 4/1974 | Engel et al. | 37/453 |
| 3,959,901 | 6/1976 | Klett | 37/452 |
| 4,027,408 | 6/1977 | Ramella et al. | 37/455 |
| 4,101,318 | 7/1978 | Rudy | 75/240 |
| 4,321,762 | 3/1982 | Hemphill | 37/452 |
| 4,965,945 | 10/1990 | Emrich | 37/456 |
| 5,016,365 | 5/1991 | Robinson | 37/141 T |
| 5,081,774 | 1/1992 | Kuwano | 37/460 |
| 5,111,600 | 5/1992 | Lukavich et al. | 37/141 T |
| 5,375,350 | 12/1994 | Maybon | 37/460 |

*Primary Examiner*—Terry Lee Melius
*Assistant Examiner*—Victor Batson
*Attorney, Agent, or Firm*—O. Gordon Pence

[57] ABSTRACT

Teeth are normally mounted on the leading edge of a earthworking implement such as a bucket to aid in the penetration of the material being worked. Furthermore, hard material has been applied to selected surfaces of teeth to increase their wear life. However, in many applications the hard material is located on the surface thereof and is subject to impacts which cause the hard material to prematurely chip away. In the subject arrangement, a symmetrical tooth is provided and has a raised lug on the top and bottom thereof each with a groove defined therein and filled with an abrasion resistant material. Since the sides of the tooth on either side of the raised lugs are thinner, they will wear at a quicker rate than the raised lugs having the abrasion resistant material disposed in the respective grooves therein. Consequently, the raised lug increases the strength of the tooth, the abrasion resistant materials in the grooves of the raised lug increases the wear life thereof and improves the sharpness of the tooth during its useful life since the sides of the tooth wear at a faster rate.

1 Claim, 3 Drawing Sheets

TOOTH HAVING ABRASION RESISTANT MATERIAL APPLIED THERETO

TECHNICAL FIELD

This invention relates generally to an earthworking tooth and more particularly to an earthworking tooth having abrasion resistant material applied to selected areas thereof.

BACKGROUND ART

It is well known that when teeth, such as bucket teeth, are used in abrasive conditions, the material of each tooth wears at a quick rate due to the abrasive action of the material being worked. The increased wear rate shortens the usable life of the tooth plus, during use, the tooth normally becomes blunt which inhibits its ability to penetrate the material being worked. Additionally, trying to force a blunted tooth to penetrate the material being worked requires additional effort, thus, reducing the overall operating efficiency of the machine. Various attempts have been made to increase wear life and maintain sharpness during the useful life of the tooth. In various ones of the known teeth, a hard material insert or a hard weld material is applied to the top surface of the tooth and in another one of the prior art teeth, hard material is applied to the bottom of the tooth. In the first mentioned teeth, the hard weld and/or hard material inserts are applied to the top of the tooth, thus, not protecting the bottom thereof. In the latter illustrated tooth, the hard weld is additionally applied to the bottom of the tip which does aid in resisting prematurely wearing of the bottom of the tip. In order to better protect the abrasion resistant material, it is desirable to have material applied to the base material of the tooth in a protected area so that it will not prematurely chip away during use. Furthermore, it is beneficial to have a tooth in which the wear rate is controlled to aid in maintaining the sharpness of the tooth while providing the structure to allow the tooth to be used in various applications. Even though it is desirable to add additional wear life and to maintain sharpness of the tooth, it is also an important objective to maintain the strength of the tooth in order to resist breakage thereof.

The present invention is directed to overcoming one or more of the problems as set forth above.

DISCLOSURE OF THE INVENTION

In one aspect of the present invention, a tooth is provided for use on an earthworking implement. The tooth includes a rearward mounting portion adapted for attachment of the tooth to the earthworking implement and a forward ground engaging portion. The forward ground engaging portion has a leading edge portion and a raised lug having a transverse width and a longitudinally extending length. The raised lug is located on the top of the tooth and extends rearwardly from a location adjacent the leading edge portion. A groove is centrally defined in the transverse width of the raised lug and extends along the longitudinally extending length thereof. An abrasion resistant material is disposed in the groove.

The present invention provides a simple tooth having an abrasion resistant material applied thereto to increase the life of the tooth while maintaining operating sharpness and strength thereof.

BEST MODE FOR CARRYING OUT THE INVENTION

Figure 1:
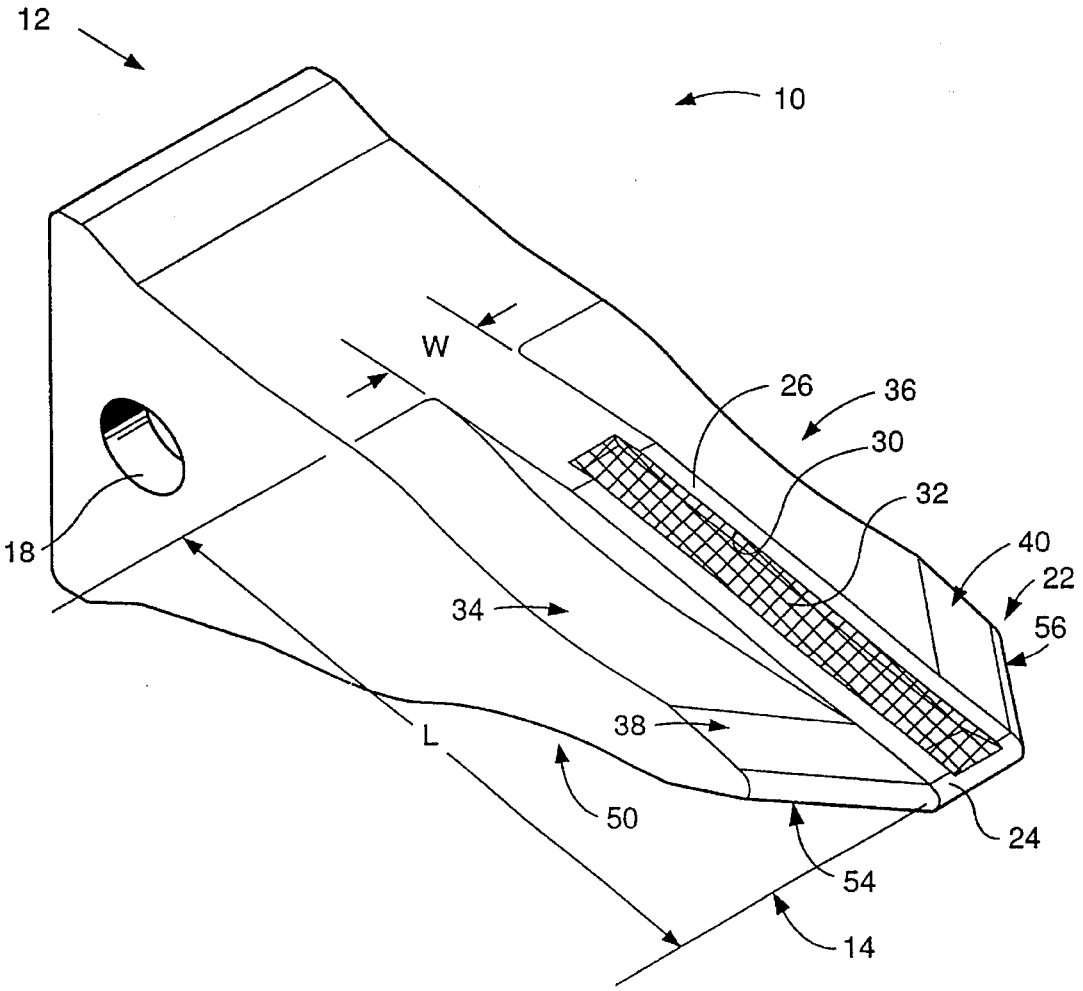
FIG. 1 is an isometric view of a tooth of the subject invention.
Figure 2:
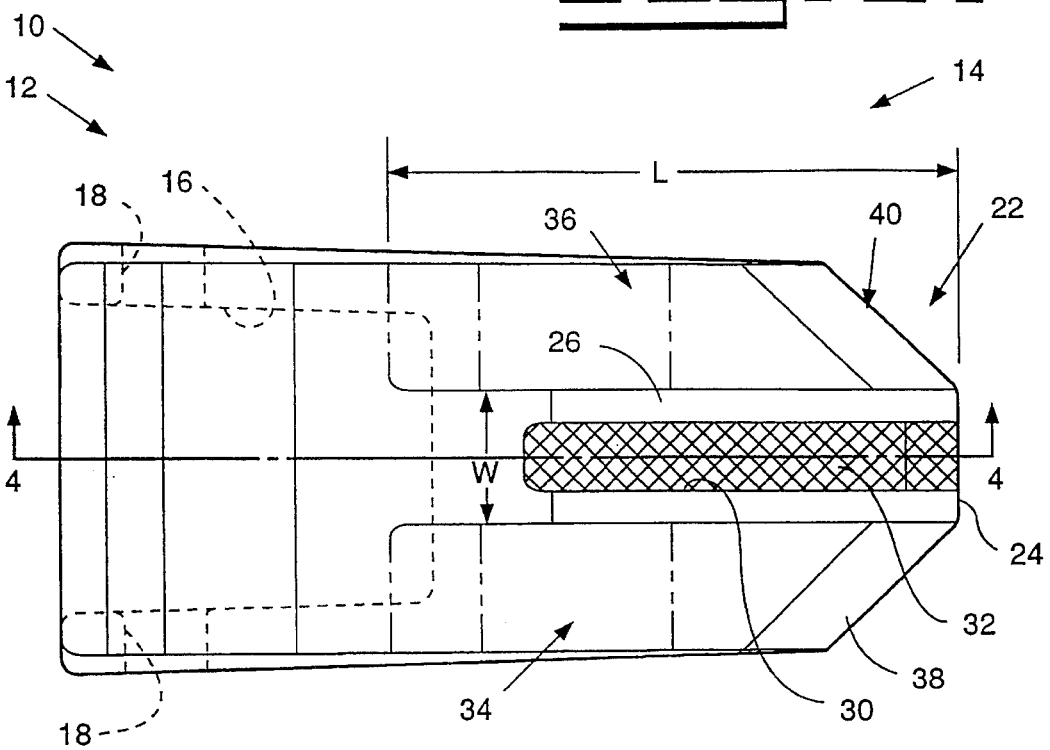
FIG. 2 is a top view of the tooth of FIG. 1.
Figure 3:
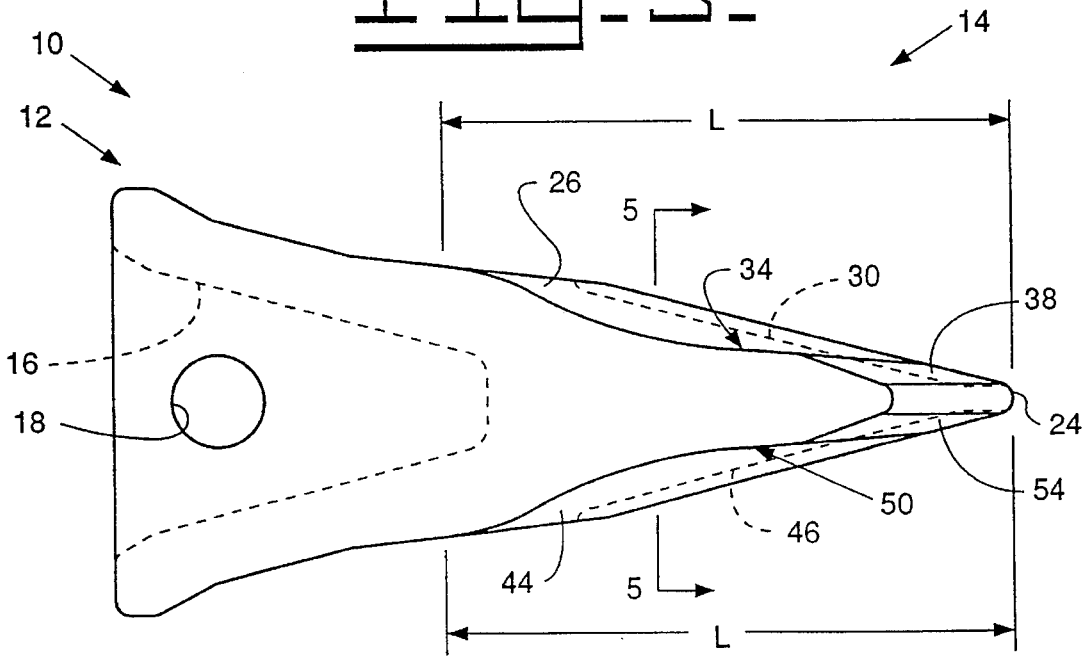
FIG. 3 is a side view of the tooth of FIG. 1.
Figure 4:
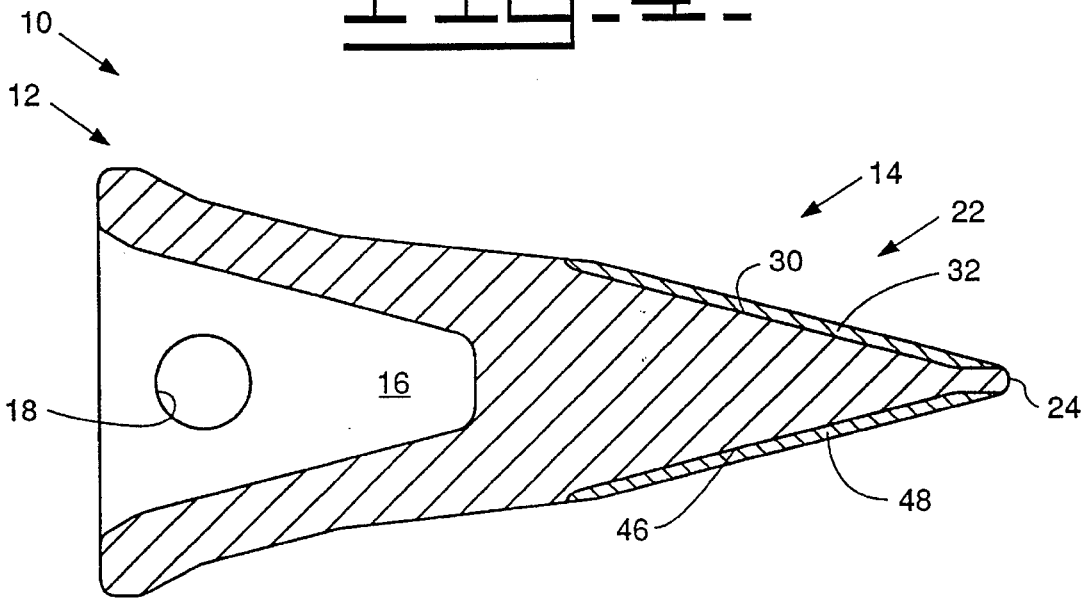
FIG. 4 is a cross-sectional view taken along line 4—4: of FIG. 2.
Figure 5:
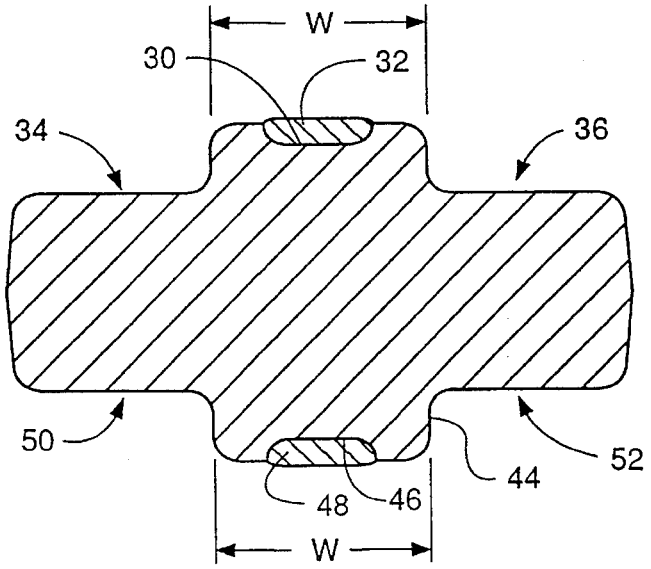
FIG. 5 is an enlarged cross-sectional view taken along line 5—5 of FIG. 3.

Referring to the drawings, a tooth 10 is illustrated. The tooth 10 is adapted for use in a well known manner, on an earthworking implement (not shown). The tooth 10 has a rearward mounting portion 12 and a forward ground engaging portion 14. The rearward mounting portion 12 has a cavity 16 that is operative to receive a nose portion of an adapter that is secured to the implement. A pair of aligned openings 18 are defined in the rearward mounting portion in intersecting relationship with the cavity 16. The cavity 16 and the pair of aligned openings 18 could be of different shapes, sizes and configurations without departing from the essence of the invention.

The forward ground engaging portion 14 extends from the rearward mounting portion 12 and has a leading edge portion 22 with a forward edge 24 located at the forward most end of the tooth 10.

A raised lug 26 is located on the top side of the forward ground engaging portion 14. The raised lug 26 has a transverse width "W" and a longitudinally extending length "L". The raised lug 26 blends with the leading edge portion 22 and originates at the forward edge 24. A groove 30 is centrally defined in the transverse width "W" and extends along at least a portion of the longitudinally extending length "L" thereof. An abrasion resistant material 32 is disposed in the groove 30 and extends from the forward edge 24 along the entire length of the groove 30. It is recognized that the abrasion resistant material 32 could be disposed in the groove along any portion thereof without departing from the essence of the invention.

Respective wear portions 34,36 are disposed on each side of the raised lug 26. The respective wear portions 34,36 generally increases in thickness from the leading edge portion 22 rearwardly therefrom. Respective forward ends 38,40 of the respective wear portions 34,36 are angled rearwardly from a point adjacent the raised lug 26. The rearward most end of each of the wear portions 34,36 blends with the raised lug 26 at a location spaced rearwardly from the leading edge portion 22. Another raised lug 44 is disposed on the bottom of the forward ground engaging portion 14. The other raised lug 44 has a transverse width "W" and a longitudinally extending length L. The other raised lug 44 extends rearwardly from an area adjacent the leading edge portion 22. In the subject embodiment, the other raised lug 44 blends with the leading edge portion and originates at the forward edge 22. Another groove 46 is centrally defined in the transverse width "W" of the other lug 44 and extends along at least a portion of the longitudinally extending length "L" thereof. Another abrasion resistant material 48 is disposed in the other groove 46 and extends from the forward edge 24 along the entire length of the other groove 46. As previously noted with respect to the abrasion resistant material 32 in the groove 30, the abrasion resistant material 48 could be disposed along any portion of the groove 46 without departing from the essence of the invention.

Respective other wear portions 50,52 are disposed on each side of the other raised lug 44. Each of the other wear portions 50,52 increases in thickness from the leading edge portion 22 rearwardly therefrom. Likewise, the rearward most end of each of the other wear portions 50,52 blends with the other raised lug 44 at a location spaced from the leading edge portion 22. Each of the other wear portions 50,52 has respective forward ends 54,56 that are angled rearwardly from a point adjacent the other raised lug 44.

The raised lug 26 and the corresponding wear portions 34,36 disposed on either side thereof on the top of the forward ground engaging portion 14 and the other raised lug 44 and its corresponding wear portions 50,52 on the bottom side of the forward ground engaging portion 14 are substantially the same size. Consequently, the tooth 10 is a symmetrical tooth that allows it to be turned over so that the top side would become the bottom side and vice versa without changing the orientation of the tooth 10 on the earthworking implement.

Even though, in the subject embodiment, the forward ends 38,40 and 54,56 are angled rearwardly, they could be oriented transverse without departing from the essence of the invention. Likewise, even though the respective wear portions 34,36 and the other wear portions 50,52 are illustrated as having a radius wherein the thickness is continually increasing rearwardly from the forward edge 24, it is recognized that the thickness could increase in a stepped relationship as opposed to a smooth continuous radius.

INDUSTRIAL APPLICABILITY

In use, the tooth 10 is mounted on the earthworking implement, such as an excavator bucket, and is used to penetrate the material being loaded into the bucket. As the tooth 10 wears from use, the respective wear portions 34,36 on the top side of the forward ground engaging portion 14 and the other wear portions 50,52 on the bottom of the forward ground engaging portion 14 wear at a faster rate than the raised lugs 26,44. This is evident, since the raised lugs 26,44 have the abrasive resistant material 32,48 disposed in the respective grooves 30,46. Since the abrasion resistant materials 32,48 are disposed in the respective grooves 30,46, they are generally protected from chipping due to the fact they are protected by the sides of the grooves 30,46. By having the abrasion resistant material on the raised lugs 26,44, the tooth is protected from excessive wear even if the bucket is used in a curling action as would be the case on an excavator bucket or if it is being used in a sliding relationship on a loader bucket. Even though the subject arrangement could be utilized on a loader bucket, it is recognized that it has more benefit when being used on an excavator bucket or in a situation in which the tooth is being used in arcuate motion.

Since the tooth 10 is symmetrical in shape, any increased wear on one side thereof can be offset by removing the tooth 10 and turning it over so that the heavily worn side can be placed in a less sever environment and the unworn area can be utilized which increases the effective life of the tooth 10. This controlled wear also aids in maintaining a sharp tooth for better penetration. Since the tooth 10 has a raised lug both on the top and bottom thereof, the tooth 10 is less likely to be subjected to breakage since the raised lugs 26,44 on the top and bottom provide increased cross-sectional strength while permitting the tooth 10 to maintain its sharpness during its useful life.

In view of the foregoing, it is readily apparent that the tooth 10 of the subject invention is a simple arrangement, is less subject to breakage, and maintains its sharpness which increases the efficiency of the tooth over a longer period of time.

Other aspects, objects, and advantages of this invention can be obtained from a study of the drawings, the disclosure, and the appended claims.

We claim:

1. A reversible earthworking tooth having a rearward mounting portion and a forward ground engaging portion, said forward ground engaging portion being symmetrical in shape and comprising:

a generally sharp forward leading edge having a central portion and a pair of side portions, each one of said side portions angling laterally outwardly and rearwardly from said central portion toward said mounting portion;

a centrally disposed raised lug having its top and its bottom extending from said central portion of the leading edge and each tapering outwardly from said central portion to said rearward mounting portion, the top and bottom of said raised lug each having a groove centrally defined in the transverse width and extending generally along the longitudinal length of said lug;

a pair of side wear portions, one of said wear portions being disposed on a respective one of the opposite sides of said raised lug and each extending rearwardly from one of said side portions of the leading edge to said rearward mounting portion and each having a forward portion of a lesser increasing thickness than said raised lug and a rearward portion that increases in thickness from the forward portion rearwardly and that blends into said rearward mounting portion; and an abrasive resistant material being disposed in each of said top and bottom grooves of said raised lug to provide said lug with a lower wear rate than said side wear portions in order to maintain the sharpness of the tip during its useful life.

* * * * *